United States Patent [19]

Harbaugh

[11] 4,334,829

[45] Jun. 15, 1982

[54] SPUTTER-ION PUMP FOR USE WITH ELECTRON TUBES HAVING THORIATED TUNGSTEN CATHODES

[75] Inventor: Willis E. Harbaugh, Leola, Pa.

[73] Assignee: RCA Corporation, New York, N.Y.

[21] Appl. No.: 121,877

[22] Filed: Feb. 15, 1980

[51] Int. Cl.[3] ..... F04B 37/02

[52] U.S. Cl. ..... 417/49; 316/13; 316/32; 417/53

[58] Field of Search ..... 417/48, 49, 53; 316/13, 316/14, 15, 32; 313/174

[56] References Cited

U.S. PATENT DOCUMENTS

| | | | |
|---|---|---|---|
| 1,854,926 | 4/1932 | De Broske | 313/178 |
| 2,988,265 | 6/1961 | Reich | 417/49 |
| 2,988,657 | 6/1961 | Klopfer et al. | 417/49 |
| 2,993,638 | 7/1961 | Hall et al. | 417/49 |
| 3,094,639 | 6/1963 | Jepsen | 417/49 |
| 3,152,752 | 10/1964 | Vanderslice | 417/49 |
| 3,240,569 | 3/1966 | Buescher | 417/49 |
| 3,244,933 | 4/1966 | Schmidt et al. . | |
| 3,542,488 | 11/1970 | Hall . | |
| 3,542,488 | 11/1970 | Hall | 417/49 |
| 3,780,501 | 12/1973 | Della Porta et al. . | |

*Primary Examiner*—William L. Freeh
*Assistant Examiner*—Edward Look
*Attorney, Agent, or Firm*—Eugene M. Whitacre; Dennis H. Irlbeck; Vincent J. Coughlin, Jr.

[57] ABSTRACT

A sputter-ion pump for use in combination with an electron tube having at least one thoriated tungsten cathode comprises a vacuum envelope and a getter-cathode within the envelope. The getter cathode comprises a first cathode member consisting of at least one reactive material selected from the group consisting of titanium, zirconium, thorium, tantalum, niobium and vanadium. A second cathode member, consisting, e.g., of a reactive material and carbon, provides a recarburizing atmosphere for forming, in situ, a tungsten carbide layer on the thoriated tungsten cathode of the electron tube so as to increase the life of the electron tube.

24 Claims, 3 Drawing Figures

SPUTTER-ION PUMP FOR USE WITH ELECTRON TUBES HAVING THORIATED TUNGSTEN CATHODES

BACKGROUND OF THE INVENTION

The invention relates to a sputter-ion pump and particularly to a sputter-ion pump for use with an electron tube having a thoriated tungsten cathode.

Certain power tubes suffer a loss of performance which increases with time of operation. Such tubes contain thoriated tungsten cathodes which normally operate for 10,000 to 20,000 hours of life before the cathodes lose their ability to emit electrons. The thoriated tungsten cathodes employed in these tubes consist of a tungsten wire or bar to which has been added thorium oxide in amounts of one to two percent by weight. In order to make the cathodes electronically active and to have a long life, the cathodes are normally carburized to a depth such that the carburized area is 20 to 40 percent of the cross-sectional area of the cathode. Carburizing is normally carried out as a separate operation during tube construction. The carburizing procedure consists of heating the cathode to a high temperature within the range of 1800°–2600° K. (usually 2600° K.) in a carbonaceous atmosphere. The carbon reacts with the tungsten to form a layer of tungsten carbide on the surface of the cathode. Variations in temperature and heating time are used to control the depth of the carbide layer. While the carbide layer is necessary for electron emission, the depth of the layer must not be too great or the cathode will become too brittle to use.

The carbide layer enhances the ability of the thoriated tungsten to emit electrons by causing a chemical reduction of the thorium oxide to thorium metal. The thorium metal diffuses to the surface the cathode where it forms a monolayer of thorium atoms. The thorium on tungsten electropositive dipole effect which is used to form a low work function cathode surface is well known and has been described in the literature.

Many power tubes with long operating lives have been analyzed to determine the reason for low electron emission at the end of life. It has been determined that the end of useful electron emission usually occurs when the carbon is depleted from the surface of the thoriated tungsten cathode so that the cathode can no longer reduce thorium oxide to thorium for use in the emission process. In each case a large amount of thorium oxide remains in the base metal of the cathode; however the thorium oxide is unavailable for electron emission because of the lack of carbon on the surface of the cathode.

It is well known in the art to permanently install or couple a getter pump to vacuum tubes such a klystron and image intensifier tubes to maintain a vacuum within the tube. Such arrangements are described in U.S. Pat. No. 3,244,933 to Schmidt et al. issued on Apr. 5, 1966 and entitled, "Device of the Kind Comprising a High-Power Klystron With Getter-ion Pump Connected Thereto", and in U.S. Pat. No. 3,780,501 to Della Porta et al. issued on Dec. 25, 1973 and entitled, "Getter-Pumps". To activate the aforementioned pump and to cause it to getter residual gases and thereby increase the life of the vacuum tubes using such pumps, a supply of getter material such as zirconium, titanium, tantalum or niobium is activated in a known manner to create a gettering surface.

While getter pumps and particularly sputter-ion pumps such as those described in the above mentioned Schmidt et al. patent are useful for obtaining low operating pressure by gettering residual gases generated within the electron tubes, such pumps are incapable of rejuvenating thoriated tungsten cathodes so as to increase useful tube life beyond 10,000 to 20,000 hours.

U.S. Pat. No. 3,542,488 to Hall, issued on Nov. 24, 1970 describes an improved sputter-ion pump having cathode members constructed from at least two different elements in order to increase the pumping capability of the sputter-ion pump. The Hall patent lists forty four different elements, including carbon that may be combined to provide a higher pumping rate. There is no suggestion in the Hall patent that a sputter-ion pump may be used to rejuvenate the thoriated tungsten cathode of an electron tube attached thereto.

SUMMARY OF THE INVENTION

An improved sputter-ion pump for use in combination with an electron tube having at least one thoriated tungsten cathode comprises a vacuum envelope and a getter-cathode within the envelope. The getter cathode includes recarburizing means for forming, in situ, a tungsten carbide layer on the thoriated tungsten cathode of the electron tube so as to increase the life of the electron tube.

DETAILED DESCRIPTION OF THE PREFERRED EMBODIMENT

Figure 1:
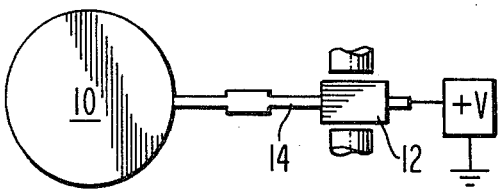
FIG. 1 is a schematic view of a typical power tube having an appendant sputter-ion pump of the present invention.

As shown in FIG. 1 a power tube 10 such as the RCA 7835 having at least one thoriated tungsten cathode (not shown) located therein is attached to a sputter-ion pump 12 by means of a vacuum tight tubulation 14 extending from the sputter ion pump 12 to the tube 10 and connected therebetween.

Figure 2:
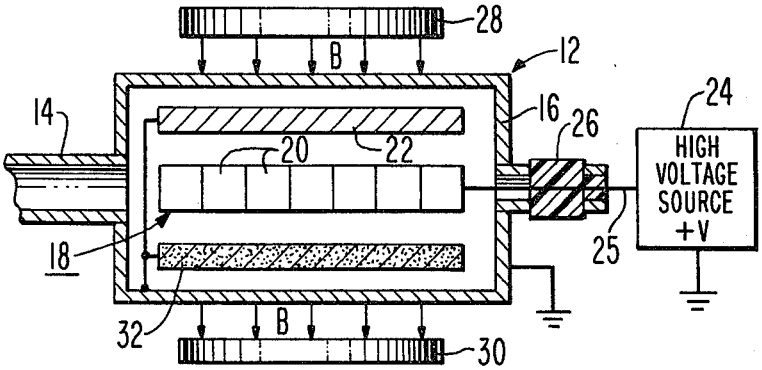
FIG. 2 is a cross-sectional view of the novel sputter-ion pump.

The sputter-ion pump 12 as shown in FIG. 2 comprises a vacuum envelope 16 of a non-magnetic material such as stainless steel or copper. The tubulation 14 is attached, for example, by brazing to the envelope 16. Within the envelope 16 are a plurality of pump elements including a honeycomb-like cellular anode structure 18 formed of a plurality of open anode cells 20, and a first cathode member 22 disposed to one side of the anode 18. The cathode member 22, which is constructed of a reactive getter material such as titanium, zirconium, thorium, tantalum, niobium or vanadium, either alone or in combination, is in the form of a flat plate extending substantially parallel to the major plane of the anode 18. The opening in each of the anode cells 20 is substantially perpendicular to the cathode member 22. A positive high voltage source 24 is connected to the anode 18 through a conductor 25 extending through an insulator 26. The cathode member 22 is connected to a lower potential, illustratively shown as ground, through the envelope 16. Two magnetic pole pieces 28 and 30 oppositely disposed outside of the envelope 16 establish a magnetic field within the envelope extending axially to the openings in the anode cells 20 in the direction shown and in a conventional manner.

In accordance with the present novel structure, the ion pump is also provided with a source of carbon to provide means for recarburizing, in situ, a thoriated tungsten cathode (not shown) of the super power tube 10. Referring again to FIG. 2, the recarburizing means includes a second cathode member 32 parallel to the first cathode member 22 but disposed on the opposite side of the anode 18 and spaced therefrom. The second cathode member 32 comprises, in combination, at least one reactive material consisting of titanium, zirconium, thorium, tantalum, niobium and vanadium, and a quantity of carbon. The cathode member 32 may be formed, for example, from a mixture of powders of the aforementioned materials which are pressed and sintered to form a solid mass. For reasons that will be discussed later, the quantity of carbon in the cathode member 32 should be controlled so that there is more reactive material than carbon available for sputtering.

In operation, a positive potential in the order 5,000 to 10,000 volts is applied to the anode 18 from high voltage source 24. The envelope 16 and the cathode members 22 and 32 are grounded and operated at zero potential. With these potentials applied, a region of intense electric field is provided between the anode 18 and each of the cathode members 22 and 32. A magnetic field substantially parallel to the electric fields is provided by magnets 28 and 30.

Within the region between the anode 18 and the cathode members 22 and 32 a stray electron (not shown) will be attracted toward the positive anode 18. In its flight towards the anode 18 the electron will gain in kinetic energy and may collide with a neutral gas molecule within the device. If the electron has gained sufficient energy it will ionize the neutral molecule producing a free electron and a positive ion. The positive ion will then be attracted to one of the cathode members 22 or 32.

The positive ion will pick up a considerable amount of kinetic energy in its flight to one of the cathode members and upon collision with one of the cathode members will disintegrate a portion of the cathode member 22 or 32 and will also knock out secondary electrons from the cathode member which may further enhance the ionization of the gas. In this manner disintegration of the cathode members 22 and 32 is produced. Particles of cathode material which are dislodged by the ion bombardment are sputtered within the interior of the envelope and condense upon the interior surfaces thereof. In particular a high percentage of the cathode material will be condensed upon surfaces not subject to resputtering by positive ion bombardment such as, for example, the anode structure 18. Since the cathode material of element 22 consists of a reactive metal and element 32 comprises a reactive metal and carbon, the metal will serve to entrap other gaseous molecules that happen to come in contact therewith. It is through this entrapment mechanism that the pressure within the sputter-ion pump 12 is reduced, hence reducing the pressure in the connected super power tube 10.

The magnetic field produced by magnets 28 and 30 serves to impact a cycloidal or spiral trajectory to electrons which have a slight transverse velocity in the direction of the magnetic field. The electrons are essentially trapped due to the magnetic field and are reflected back and forth in spiral trajectories between the mutually opposed, spaced apart cathode members 22 and 32 and through the openings in the anode structure 18.

In addition to the aforementioned pumping action due to the sputtering of reactive material from the cathode members 22 and 32, carbon, sputtered from the surface of the second cathode member 32, will combine with residual gas atoms within sputter-ion pump 12 to form carbon compounds. Since one of the main constituents of the residual gases in all vacuum devices is hydrogen, some of the carbon will unite with the residual hydrogen to form methane gas, $CH_4$. It has been observed that methane gas is pumped very slowly by sputter-ion pumps; therfore, some of the methane gas formed in the pump 12 will be transferred by differential pressure through the tubulation 14 into the volume of the super power tube 10 to which the sputter-ion pump 12 is appended. Methane gas, at very low pressure, will then contact the thoriated tungsten cathode (not shown) of the super power tube 10 and serve to recarburize it. In addition to methane, carbon monoxide, CO, is, and carbon dioxide, $C0_2$, may, also be present in some vacuum devices. These latter-mentioned compounds are formed by carbon uniting with residual oxygen that may be present. These carbon compounds may further aid in the recarburizing process.

During the operation of the super power tube 10, the hot surface of the thoriated tungsten cathode will disassociate the methane into hydrogen and carbon. The carbon will react with the tungsten of the thoriated tungsten cathode to form an additional carbide layer on the surface of the cathode, and the hydrogen produced by the reaction will be released to be returned to the sputter-ion pump 12 where it will be gettered as described above. In this manner, the thoriated tungsten cathode will be kept in a carburized condition long after the initial carbide layer, formed during construction of the tube, has been depleted by gas attack and evaporation.

Figure 3:
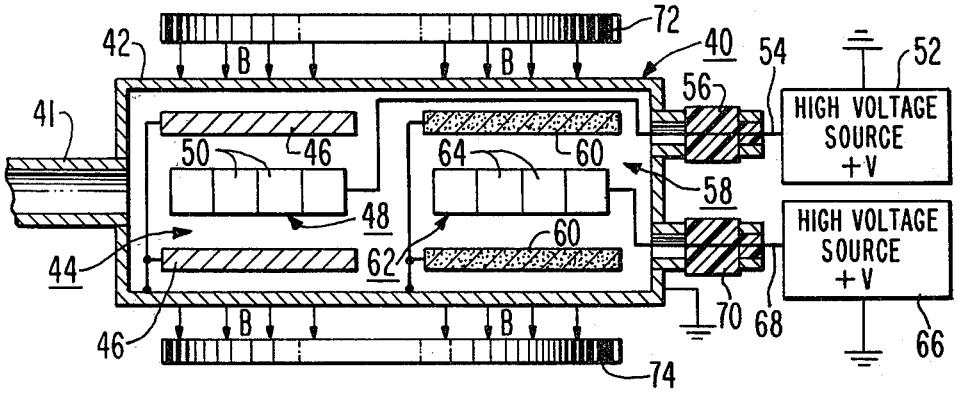
FIG. 3 is a cross-sectional view of an alternate sputter-ion pump of the present invention.

Referring now to FIG. 3, there is shown another embodiment of the improved sputter-ion pump. In this embodiment a multi-stage sputter-ion pump 40 is used in combination with an electron tube such as the super power tube 10 described above. A tubulation 41 connects the sputter-ion pump 40 to the power tube 10. The sputter-ion pump 40 includes an envelope 42 similar to envelope 16 of the preferred embodiment. Envelope 42 includes therein a first pumping stage 44 comprising a pair of spaced apart first getter cathode members 46 of reactive material such as titanium, zirconium, thorium, tantalum, niobium and vanadium. A first anode structure 48 comprising a plurality of honeycomb-like individual cells 50 is disposed between the pair of first cathode member 46. A positive first high voltage source 52 is connected to the anode 50 by means of a high voltage lead 54 extending through an insulator 56. The pair of cathode members 46 are connected to a lower potential, such as ground, through the sputter-ion pump envelope 42. Also within the sputter-ion pump 40 is a second pumping stage 58 which includes a pair of spaced apart second getter cathode members 60. Each of the members 60 comprises a reactive material combined with carbon. Each of the members 60 is substantially identical to the aforementioned cathode member 32. A second anode structure 62 comprising a plurality of individual honeycomb-like anode cells 64 is disposed between the second pair of getter cathode members 60. A second high voltage source 66 provides a positive potential to the second anode 62 through connecting lead 68 which is insulated from the sputter-ion pump envelope 42 by an insulator 70. The second cathode members 60 are connected to a lower potential such as ground, through the sputter-ion pump envelope 42. Two magnetic pole pieces 72 and 74 oppositely disposed outside of envelope 42 establish a magnetic field within envelope 42 extending axially of the first anode 48 and the second anode 62.

The operation of the sputter-ion pump 40 is similar to the operation of sputter-ion pump 12 described above with the exception that the first pumping stage 44, energized by means of source 52, operates continuously to maintain a continuous pumping action thereby providing the gettering surface to evacuate the super power tube 10. The second pumping stage 58, separately energized by means of source 66, may be operated periodically to establish the desired recarburizing atmosphere which in turn provides a second tungsten carbide layer (not shown) to be deposited on the surface of the thoriated tungsten cathode (also not shown) of the power tube 10 which replaces the initial, depletable layer of tungsten carbide on the surface of said thoriated tungsten cathode. By properly timing the operation of the two pump sections, the methane gas level can be maintained at a desired level. The pressure of the gas within the tube 10 can be ascertained by observing, with a current meter (not shown) the ion current flowing in the sputter-ion pump 40. Since the ion current is a direct measure of the amount of residual gas within the pump this parameter can be used to establish the desired gas level within the electron tube 10. In fact, an automatic feedback circuit, not shown, but well known in the art, can be used to switch on the methane producing section of the pump 40, as required, to keep the methane pressure constant within the electron tube 10.

GENERAL CONSIDERATIONS

It is important that the amounts of methane, carbon monoxide and carbon dioxide present in the electron tube 10 be controlled so that just the right amounts are present to maintain a proper carbide layer on the thoriated tungsten cathode. If the quantity of gaseous carbon compounds recited above is too high, excessive recarburization could occur which might change the resistance of the thoriated tungsten cathode or seriously embrittle it. Also, electron tube operation could be adversely affected if the carburizing gas level is too high; i.e., greater than $10^{-7}$ torr. On the other hand, if the aforementioned gas level is too low, proper recarburization of the thoriated tungsten cathode will not occur.

By controlling the quantity of carbon present in the sputter-ion pump cathode, it is possible to control the amounts of gaseous carbon compounds generated within the sputter-ion pump and transferred to the electron tube 10.

In general, the total quantity of reactive metal present in the sputter-ion pump cathode should be about equal to or greater than the quantity of carbon to insure that tube operation is not adversely affected. By way of example, a sputter-ion pump cathode, such as titanium carbide, having a ratio of about 9 parts, by weight, of reactive metal, to about 1 part, by weight, of carbon should be satisfactory for recarburizing the thoriated tungsten cathodes of an electron tube such as the RCA 7835 power tube. However, the exact ratio of reactive metal to carbon can be varied and the ratio depends on such factors as the total surface area of the thoriated tungsten cathodes to be recarburized and the efficiency of the sputter-ion pump for gettering the recarburizing gases generated therein.

What is claimed is:

1. In a sputter-ion pump for use in combination with an electron tube having at least one thoriated tungsten cathode, said sputter-ion pump comprising a vacuum envelope permanently in communication with the interior of said tube, a getter-cathode within said envelope, an anode structure, means for establishing an electric field between said anode structure and said cathode and means for establishing a magnetic field substantially parallel to said electric field, the improvement wherein said getter cathode comprises:

a cathode member including a mixture of at least one reactive material and carbon for forming, in situ, a tungsten carbide layer on the thoriated tungsten cathode of said electron tube so as to increase the life of said electron tube.

2. The pump as in claim 1 wherein said reactive material is selected from the group consisting of titanium, zirconium, thorium, tantalum, niobium and vanadium.

3. The pump as in claim 1 whereas said cathode member comprises titanium carbide.

4. The pump as in claims 2 or 3 wherein said cathode member contain between 50 and 90 percent reactive material.

5. The pump as in claim 1 wherein said mixture comprises carbon for generating gaseous carbon compounds within said pump by the combination of carbon sputtered from said getter-cathode member and residual gases.

6. The pump as in claim 5 wherein said gaseous carbon compounds include methane, formed within said pump by the combination of carbon sputtered from said getter cathode member and residual hydrogen.

7. The pump as in claim 5 wherein said gaseous carbon compounds further include carbon monoxide gas formed within said pump by the combination of carbon sputtered from said getter-cathode member and residual oxygen.

8. The pump as in claim 5 wherein said gaseous carbon compounds further include carbon dioxide gas formed within said pump by the combination of carbon sputtered from said getter-cathode member and residual oxygen.

9. In a sputter-ion pump for use in combination with an electron tube having at least one thoriated tungsten cathode, said sputter-ion pump comprising a vacuum envelope permanently in communication with the interior of said tube, a pair of getter-cathodes within said envelope, an anode structure disposed between said getter-cathodes, means for establishing substantially identical electric fields between said anode structure and each of said cathodes and means for establishing a magnetic field substantially parallel to said electric fields, the improvement wherein said getter cathodes comprise:

a first cathode member including at least one reactive material selected from the group consisting of titanium, zirconium, thorium, tantalum, niobium and vanadium, and a second cathode member including a mixture of at least one reactive material and carbon for forming, in situ, a tungsten carbide layer on the thoriated tungsten cathode of said electron tube so as to increase the life of said electron tube.

10. The pump as in claim 9 wherein said reactive material is selected from the group consisting of titanium, zirconium, thorium, tantalum, niobium and vanadium.

11. The pump as in claim 9 whereas said second cathode member comprises titanium carbide.

12. The pump as in claims 10 or 11 wherein said second cathode member contain between 50 and 90 percent reactive material.

13. The pump as in claim 9 wherein said mixture comprises carbon for generating gaseous carbon compounds within said pump by the combination of carbon sputtered from said getter-cathode member and residual gases.

14. The pump as in claim 13 wherein said gaseous carbon compounds include methane formed within said pump by the combination of carbon sputtered from said second getter cathode member and residual hydrogen.

15. The pump as in claim 13 wherein said gaseous compounds further include carbon monoxide gas formed within said pump by the combination of carbon sputtered from said second getter-cathode member and residual oxygen.

16. The pump as in claim 13 wherein said gaseous compounds further include carbon dioxide gas formed within said pump by the combination of carbon sputtered from said second getter-cathode member and residual oxygen.

17. A multistage sputter-ion pump for use in combination with an electron tube having at least one thoriated tungsten cathode, said thoriated tungsten cathode having an initial, depletable layer of tungsten carbide on a surface thereof, said pump comprising:

a vacuum enclosure permanently in communication with the interior of said tube;

a first pumping stage including at least one first getter-cathode member of reactive getter material and a first anode structure;

a second pumping stage including at least one second getter-cathode member, said second member comprising a reactive material combined with carbon; and a second anode structure;

means for establishing a first electric field between said first anode and said first member;

means for establishing a second electric field between said second anode and said second member; and means for establishing a magnetic field substantially parallel to said first and second electric field.

18. The pump as in claim 17 wherein said reactive material is selected from the group consisting of titanium, zirconium, thorium, tantalum, niobium and vanadium.

19. The pump as in claim 17 wherein said first pumping stage includes means for maintaining a continuous pumping action to evacuate said electron tube.

20. The pump as in claim 17 including means for energizing said second electric field establishing means may be separately from said first electric field establishing means so that said second pumping stage may be operated periodically to establish a recarburizing atmosphere for forming, in situ, a second tungsten carbide layer on the surface of said thoriated tungsten cathode, to replace the initial, depletable layer of tungsten carbide on said surface.

21. The pump as in claim 20 wherein said recarburizing atmosphere comprises methane gas formed within said pump by the combination of carbon sputtered from said second getter-cathode member and residual hydrogen.

22. The pump as in claim 20 wherein said recarburizing atmosphere further includes a carbon monoxide gas formed within said pump by the combination of carbon sputtered from said second getter-cathode member and residual oxygen.

23. The pump as in claim 20 wherein said recarburizing atmosphere further includes carbon dioxide gas formed within said pump by the combination of carbon sputtered from said second getter-cathode member and residual oxygen.

24. The method of increasing the life of an electron tube having a thoriated tungsten cathode wherein the emission characteristic of said thoriated tungsten cathode has deteriorated because of the depletion of carbon from a surface of said thoriated tungsten cathode thereby limiting the further reduction of thorium oxide to thorium, comprising the steps of:

appending a sputter-ion pump to said electron tube, said pump having a getter-cathode member comprising a mixture of a reactive material and a quantity of carbon, activating said electron tube so as to suitably heat said thoriated tungsten cathode to an emission temperature, and activating said sputter-ion pump so as to provide a gettering action due to said reactive material and a recarburizing atmosphere for restoring carbon to said surface of said heated thoriated tungsten cathode of said electron tube.

* * * * *

UNITED STATES PATENT AND TRADEMARK OFFICE

CERTIFICATE OF CORRECTION

PATENT NO. : 4,334,829

DATED : June 15, 1982

INVENTOR(S) : Willis Eugene Harbaugh

It is certified that error appears in the above—identified patent and that said Letters Patent is hereby corrected as shown below:

Column 8, line 8, "may be" should be deleted.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*